US011011090B2

(12) United States Patent
Huang et al.

(10) Patent No.: US 11,011,090 B2
(45) Date of Patent: May 18, 2021

(54) DISPLAY DEVICE AND DRIVING METHOD THEREOF

(71) Applicant: Au Optronics Corporation, Hsinchu (TW)

(72) Inventors: Yu-Jung Huang, Hsinchu (TW); Neng-Yi Lin, Taichung (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 16/281,111

(22) Filed: Feb. 21, 2019

(65) Prior Publication Data

US 2020/0066197 A1 Feb. 27, 2020

(30) Foreign Application Priority Data

Aug. 23, 2018 (TW) ..... 107129450

(51) Int. Cl.
*G09G 3/20* (2006.01)

(52) U.S. Cl.
CPC ..... *G09G 3/20* (2013.01); *G09G 2310/0267* (2013.01); *G09G 2310/0297* (2013.01); *G09G 2310/06* (2013.01); *G09G 2320/0219* (2013.01)

(58) Field of Classification Search
CPC ..... G09G 3/20; G09G 2310/06; G09G 2310/0267; G09G 2310/0286; G09G 2320/0219
See application file for complete search history.

(56) References Cited

U.S. PATENT DOCUMENTS

| | | | | |
|---|---|---|---|---|
| 7,145,545 | B2 | 12/2006 | Zebedee et al. | |
| 9,401,220 | B2 | 7/2016 | Ko et al. | |
| 2001/0033278 | A1* | 10/2001 | Ohta | G09G 3/3677 345/204 |
| 2002/0126071 | A1* | 9/2002 | Kojima | G09G 3/20 345/60 |
| 2011/0291712 | A1* | 12/2011 | Tobita | H03K 5/135 327/144 |
| 2013/0222220 | A1* | 8/2013 | Tobita | G11C 27/04 345/100 |
| 2013/0249884 | A1 | 9/2013 | Kim et al. | |
| 2014/0253424 | A1* | 9/2014 | Yu | G11C 19/28 345/100 |

* cited by examiner

*Primary Examiner* — Alexander Eisen
*Assistant Examiner* — Nathaniel P Brittingham
(74) *Attorney, Agent, or Firm* — JCIPRNET

(57) ABSTRACT

A display device and driving method thereof are provided. In the display device, a control circuit provides first and second start signals. In a display panel, a pixel array has a plurality of odd and even gate lines. A first and second gate circuits respectively receive the first and second start signals, and respectively provide the sequentially enabled first and second gate signals to odd and even gate lines according to the phases of the first and second start signals, respectively. One of the first and second start signals is phase-shifted by at least one clock cycle from a preset phase during a first scan period that scans from a first side to a second side of the pixel array or during a second scan period that scans from the second side to the first side of the pixel array.

20 Claims, 9 Drawing Sheets

DISPLAY DEVICE AND DRIVING METHOD THEREOF

CROSS REFERENCE TO RELATED APPLICATION

This application claims the priority benefit of Taiwan application serial no. 107129450, filed on Aug. 23, 2018. The entirety of the above-mentioned patent application is hereby incorporated by reference herein and made a part of specification.

BACKGROUND

Field of the Disclosure

The disclosure relates to a display device and a driving method thereof, and particularly to a display device having gate on array (GOA) and a driving method thereof.

Description of Related Art

Along with advancement of electronic technology, display device has become an essential tool in our daily life. In order to provide a good human-machine interface, display panel with high quality is a required part of a display device.

In conventional techniques, gate lines in a gate circuit are easily affected by parasitic effect to form parasitic capacitance, which causes feed through voltage to be generated between each of the gate lines. Specifically, the time width of the gate signal generated by the gate circuit having multiple phases is likely to be greater than the time width of one gate line, and when the gate circuit performs forward scan or/and reverse scan on pixel array, the gate circuit is likely to be affected by different feed through voltage, which causes the optimal common voltage in the pixel array to be different when the gate circuit is operated in forward scan or/and reverse scan; as a result, the quality of display frame is reduced. In view of the above, it is an important issue for practitioners of the art to find out how to effectively reduce the effect of feed through voltage generated between each of the gate lines in order to improve quality of display frame.

SUMMARY OF THE DISCLOSURE

The disclosure provides a display device and a driving method thereof, capable of effectively reducing the effect of feed through voltage generated between each of the gate lines, thereby further improving the quality of display frame shown by display panel.

A display device of the disclosure includes a control circuit and a display panel. The control circuit provides a first start signal, a second start signal, a first stop signal and a second stop signal, wherein the phase of the first start signal is different from the second start signal, and the phase of the first stop signal is different from the second stop signal. The display panel includes a pixel array, a first gate circuit and a second gate circuit. The pixel array has a plurality of odd gate lines and a plurality of even gate lines. The first gate circuit is coupled to the odd gate line and has a first control end and a second control end respectively receiving the first start signal and the first stop signal, thereby providing a plurality of sequentially enabled first gate signals to the odd gate lines according to the phases of the first start signal and the first stop signal. The second gate circuit is coupled to the even gate line and has a third control end and a fourth control end respectively receiving the second start signal and the second stop signal, thereby providing a plurality of sequentially enabled second gate signals to the even gate lines according to the phases of the second start signal and the second stop signal. Specifically, one of the first start signal and the first stop signal as well as the second start signal and the second stop signal are phase-shifted by at least one clock cycle from a preset phase in a first scan period that scans from the first side to the second side of the pixel array or in a second scan period that scans from the second side to the first side of the pixel array, wherein the first side is opposite to the second side. In the first scan period, the first control end receives the first start signal, the second control end receives the first stop signal, the third control end receives the second start signal, and the fourth control end receives the second stop signal. In the second scan period, the first control end receives the first stop signal, the second control end receives the first start signal, the third control end receives the second stop signal, and the fourth control end receives the second start signal.

In a driving method of the disclosure, a display panel includes a pixel array having a plurality of odd gate lines and a plurality of even gate lines, a first gate circuit that provides a plurality of sequentially enabled first gate signals to the odd gate lines according to the phases of the first start signal and the first stop signal, and a second gate circuit that provides a plurality of sequentially enabled second gate signals to the even gate lines according to the phases of the second start signal and the second stop signal. The driving method includes providing the first start signal, the second start signal, the first stop signal and the second stop signal through a control circuit, wherein the phase of the first start signal is different from the second start signal, and the phase of the first stop signal is different from the second stop signal; making, by using the control circuit, one of the first start signal and the first stop signal as well as the second start signal and the second stop signal to phase-shift by at least one clock cycle from a preset phase in a first scan period that scans from the first side to the second side of the pixel array or in a second scan period that scans from the second side to the first side of the pixel array, wherein the first side is opposite to the second side.

Based on the above, the display device of the disclosure is capable of using the control circuit to make the first start signal and the first stop signal or the second start signal and the second stop signal to phase-shift by at least one clock cycle from a preset phase according to the scanning direction along which the pixel array is scanned by the first start signal and the first stop signal or the second start signal and the second stop signal, such that the corresponding first gate signal or the second gate signal is phase-shifted by at least one clock cycle from a preset phase. In this manner, when each of the gate signals is operated in a high voltage level state, the gate signal on each of the gate lines of the disclosure does not overlap the adjacent gate signal, thereby avoiding occurrence of secondary feed through voltage. Meanwhile, the feed through voltage of the pixels in the pixel array can be consistent, thereby improving display quality of the display panel.

In order to make the aforementioned features and advantages of the disclosure more comprehensible, embodiments accompanying figures are described in detail below.

DESCRIPTION OF EMBODIMENTS

Figure 1A:
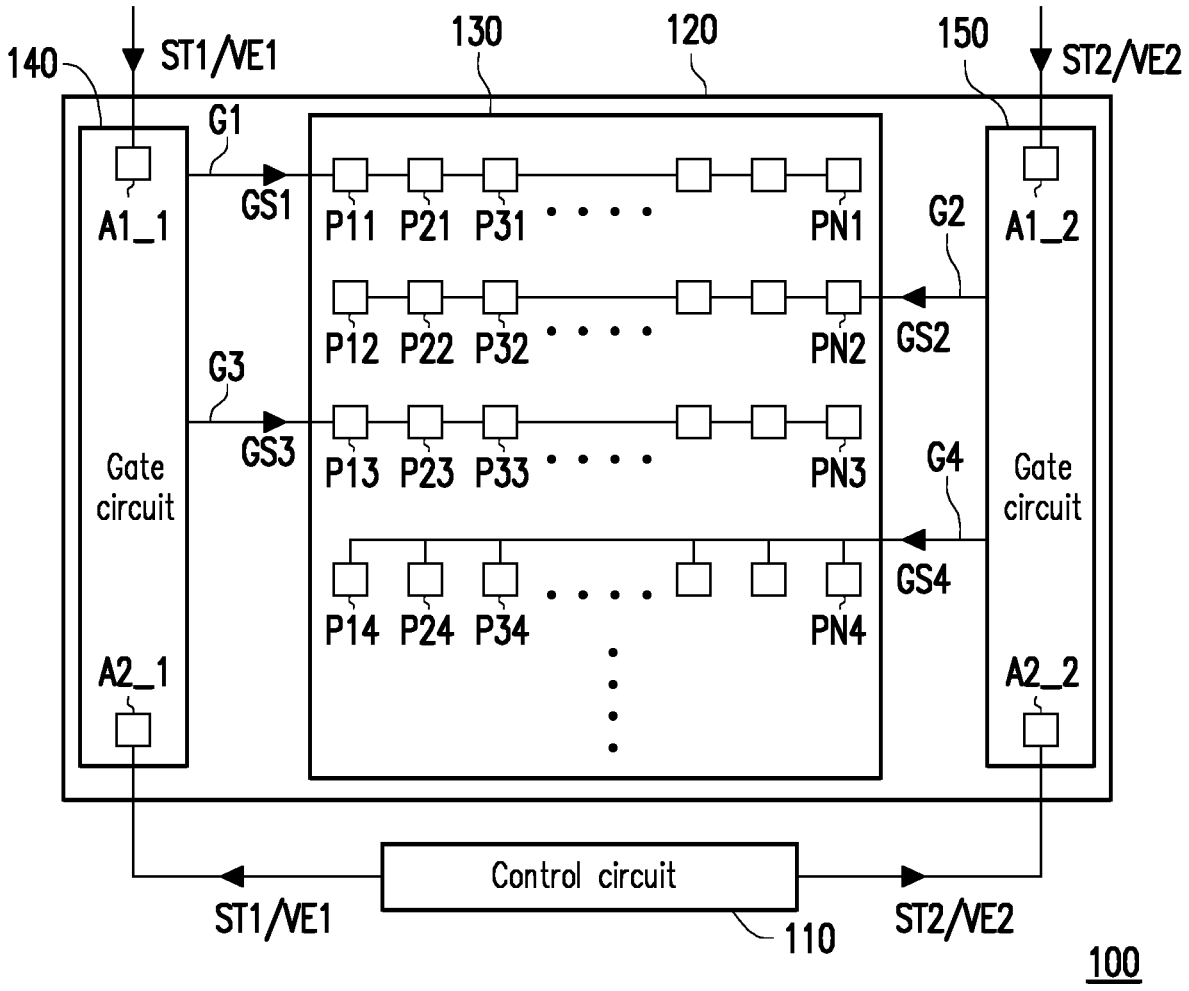
FIG. 1A is a schematic view of a display device according to an embodiment of the disclosure.

FIG. 1A is a schematic view of a display device according to an embodiment of the disclosure. Referring to FIG. 1A, in the embodiment, a display device 100 includes a control circuit 110 and a display panel 120. Specifically, the display panel 120 further includes a pixel array 130, a first gate circuit (e.g., gate circuit 140) and a second gate circuit (e.g., gate circuit 150). Meanwhile, the control circuit 110 may be a sequence controller or disposed in a sequence controller.

Specifically, in the embodiment, the control circuit 110 may provide a first start signal (e.g., start signal ST1) and a first stop signal (e.g., stop signal VE1) to a first control end (e.g., control end A1_1) and a second control end (e.g., control end A2_1) of the first gate circuit (e.g., gate circuit 140). Moreover, the control circuit 110 may also provide a second start signal (e.g., start signal ST2) and a second stop signal (e.g., stop signal VE2) to a third control end (e.g., control end A1_2) and a fourth control end (e.g., control end A2_2) of the second gate circuit (e.g., gate circuit 150). Specifically, the phase of the first start signal (e.g., start signal ST1) may be different from the second start signal (e.g., start signal ST2). Moreover, one of the first start signal ST1 (e.g., start signal ST1) and the second start signal ST2 (e.g., start signal ST2) may be phase-shifted forward or backward. Relatively, the phase of the first stop signal (e.g., stop signal VE1) may be different from the second stop signal (e.g., stop signal VE2). Further, one of the first stop signal (e.g., stop signal VE1) and the second stop signal (e.g., stop signal VE2) may be phase-shifted forward or backward, the embodiments of the disclosure provide no limitation thereto.

In this embodiment, the pixel array 130 has a plurality of pixels (such as pixels P11 to PN1, P12 to PN2, P13 to PN3, and P14 to PN4), a plurality of odd gate lines (such as gate lines G1 and G3) and a plurality of even gate lines (such as gate lines G2, G4). It should be pointed out that the pixels P11 to PN1, P12 to PN2, P13 to PN3, and P14 to PN4 are arranged in a matrix, and can be arranged at the intersection of the data line (not drawn) and the gate lines G1 to G4. Meanwhile, the pixels P11-PN1, P13-PN3 are controlled by corresponding odd gate lines (such as the gate lines G1, G3), thereby controlling the circuit operation of the pixel array 130. Also, the pixels P12-PN2 and P14 to PN4 are controlled by the corresponding even gate lines (such as gate lines G2 and G4) to control circuit operation of the pixel array 130.

In the embodiment of the disclosure, persons having ordinary skill in the art may determine the number of pixels and gate lines in the pixel array 130 according to the design requirements of the display panel 120. The disclosure is not limited to the above-exemplified number. Specifically, the above N is a positive integer. For ease of explanation, the embodiment of FIG. 1A only shows the gate lines G1 to G4 and the plurality of pixels P11 to PN1, P12 to PN2, P13 to PN3, and P14 to PN4, but the disclosure is not limited thereto.

Further, in this embodiment, the first gate circuit (such as the gate circuit 140) is coupled between the odd gate lines (such as the gate lines G1, G3) and the control circuit 110 to receive the first start signal (such as the start signal ST1) and the first stop signal (such as the stop signal VE1). The first gate circuit (e.g., the gate circuit 140) may provide a plurality of sequentially enabled first gate signals (e.g., the gate signal GS1, GS3) to the odd gate lines (such as gate lines G1, G3) according to the phase of the first start signal ST1 (e.g., the start signal ST1). Moreover, the first gate circuit (such as the gate circuit 140) may also provide a plurality of sequentially disabled first gate signals (such as the gate signal GS1, GS3) to the odd gate lines (e.g., gate lines G1, G3) according to the phase of the first stop signal (such as the stop signal VE1). On the other hand, a second gate circuit (such as the gate circuit 150) is coupled between the even gate lines (such as the gate lines G2, G4) and the control circuit 110 to receive the second start signal (such as a start signal ST2) and the second stop signal (such as stop signal VE2). Specifically, the second gate circuit (such as the gate circuit 150) may provide a plurality of sequentially enabled second gate signals (such as gate signals GS2, GS4) to the even gate lines (such as gate lines G2, G4) according to the phase of the second start signal ST2 (such as the start signal ST2). Moreover, the second gate circuit (such as the gate circuit 150) may also provide a plurality of sequentially disabled second gate signals (such as the gate signal GS2, GS4) to the even gate lines (e.g., gate lines G2, G4) according to the phase of the second stop signal (such as the stop signal VE2).

It should be noted that in the embodiment, during the first scan period (for example, during the forward scan period of the display panel 120), it is assumed that the display panel 120 performs scanning from the first side (e.g., above the pixel array 130) to the second side (for example, below the pixel array 130) of the pixel array 130. During the second scan period (e.g., during the reverse scan period of display panel 120), it is assumed that the display panel 120 performs scanning from the second side (e.g., below the pixel array 130) to the first side (for example, above the pixel array 130) of the pixel array 130.

For example, when the display device 100 is operated during the first scan period (for example, during the forward scan period of the display panel 120), the control end A1_1 and the control end A1_2 of the first gate circuit (such as the gate circuit 140) and the second gate circuit (such as the gate circuit 150) may respectively receive the first start signal (such as a start signal ST1) and the second start signal (such as a start signal ST2). At the same time, the control end A2_1 and the control end A2_2 of the first gate circuit (such as the gate circuit 140) and the second gate circuit (such as the gate circuit 150) may respectively receive the first stop signal (such as the stop signal VE1) and the second stop signal (such as stop signal VE2). On this occasion, the control circuit 110 may make the first start signal (such as the start signal ST1) and the first stop signal (such as the stop signal VE1) or the second start signal (such as the start signal ST2) and the second stop signal (e.g., stop signal VE2) to shift by at least one clock cycle from a preset phase.

Relatively, when the display device 100 is operated during the second scan period (for example, during the reverse scan period of the display panel 120), the control end A1_1 and the control end A1_2 of the first gate circuit (such as the gate circuit 140) and the second gate circuit (such as the gate circuit of 150) may respectively receive the first stop signal (such as a stop signal VE1) and the second stop signal (such as a stop signal VE2). At the same time, the control end A2_1 and the control end A2_2 of the first gate circuit (such as the gate circuit 140) and the second gate circuit (such as the gate circuit 150) may respectively receive the first start signal (such as the start signal ST1) and the second start signal (such as the start signal ST2). On this occasion, the control circuit 110 may also make the first start signal (such as the start signal ST1) and the first stop signal (such as the stop signal VE1) or the second start signal (such as the start signal ST2) and the second stop signal (e.g., stop signal VE2) to shift by at least one clock cycle from a preset phase.

In other words, during the first scan period or the second scan period, the first gate circuit (e.g., the gate circuit 140) provides the first gate signal (e.g., gate signals GS1, GS3) as a preset phase, and the second gate circuit (e.g., gate circuit 150) provides a second gate signal (e.g., gate signals GS2, GS4) that is shifted by at least one clock cycle from a preset phase. Alternatively, the first gate circuit (e.g., gate circuit 140) provides the first gate signal (e.g., gate signals GS1, GS3) that is shifted by at least one clock cycle from the preset phase, and the second gate circuit (e.g., gate circuit 150) provides the second gate signal (such as gate signal GS2, GS4) as the preset phase.

According to the above, the control circuit 110 of the embodiment may control the first gate circuit (such as gate circuit 140) through the first start signal (such as the start signal ST1) and the first stop signal (such as the stop signal VE1) during the first scan period or the second scan period, and control the second gate circuit (such as gate circuit 150) through the second start signal (such as start signal ST2) and the second stop signal (such as stop signal VE2), thereby scanning the pixel array 130. Moreover, the control circuit 110 may shift the first start signal (such as the start signal ST1) and the first stop signal (such as the stop signal VE1) or the second start signal (such as the start signal ST2) and the second stop signal (such as stop signal VE2), such that the first start signal (such as the start signal ST1) and the first stop signal (such as the stop signal VE1) or the second start signal (such as the start signal ST2) and the second stop signal (such as the stop signal VE2) are shifted by at least one clock cycle from a preset phase, thereby making the first gate signal (such as gate signal GS1, GS3) or the second gate signal (such as gate signal GS2, GS4) to shift by at least one clock cycle from a preset phase. In this manner, during the first scan period or the second scan period, the feed through voltage between the plurality of gate lines G1 to G4 of the embodiment can be consistent with each other. Moreover, when each of the gate signals GS1 to GS4 is operated in the high voltage level state, the gate signals GS1 to GS4 on each of the gate lines G1 to G4 does not overlap with the adjacent gate signals GS1 to GS4, thereby avoiding the occurrence of a secondary feed through voltage to improve the display quality of the display panel 120.

Figure 1B:
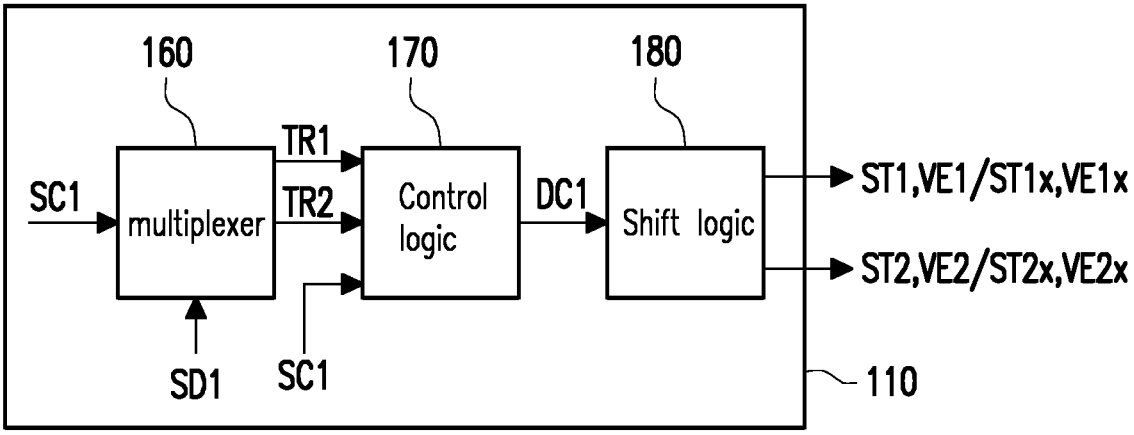
FIG. 1B is a schematic view of a control circuit according to an embodiment of the disclosure.

FIG. 1B is a schematic view of a control circuit according to an embodiment of the disclosure. Referring to FIG. 1A and FIG. 1B, in the embodiment, the control circuit 110 may include a multiplexer 160, a control logic 170, and a shift logic 180. Specifically, the input end of the multiplexer 160 may receive a scan start signal SC1, the control end of the multiplexer 160 may receive a scan direction control signal SD1. Moreover, the multiplexer 160 may provide a first trigger signal TR1 through a first output end according to the scan direction control signal SD1, and provide a second trigger signal TR2 through a second output end. Moreover, the control logic 170 may receive the scan start signal SC1, and connected to the first output end and the second output end of the multiplexer 160 to receive the first trigger signal TR1 or the second trigger signal TR2, respectively. Next, the control logic 170 is configured to provide a shift control signal DC1 that shifts the first start signal (such as the start signal ST1) and the first stop signal (such as the stop signal VE1) or the second start signal (such as the start signal ST2) and the second stop signal (such as the stop signal VE2), wherein the shift control signal DC1 may include the scan start signal SC1, but the embodiment of the disclosure is not limited thereto.

The shift logic 180 is coupled to the control logic 170 to receive the shift control signal DC1 to determine whether to shift the first start signal (such as the start signal ST1) and the first stop signal (such as the stop signal VE1) or the second start signal (such as start signal ST2) and second stop signal (such as stop signal VE2) according to the shift control signal DC1. For example, if the shift logic 180 determines that the first start signal (such as the start signal ST1) and the first stop signal (such as the stop signal VE1) need to be shifted, the shift logic 180 may provide the shifted first start signal (such as the start signal ST1*x*) and the first stop signal (such as the stop signal VE1*x*) to the gate circuit 140, and the shift logic 180 may provide the unshifted second start signal (such as the start signal ST2) and the second stop signal (such as stop signal VE2) to the gate circuit 150.

Relatively, if the shift logic 180 determines that the second start signal (such as the start signal ST2) and the second stop signal (such as the stop signal VE2) need to be shifted, the shift logic 180 may provide the unshifted first start signal (such as the start signal ST1) and the first stop signal (such as the stop signal VE1) to the gate circuit 140, and the shift logic 180 may provide the shifted second start signal (such as the start signal ST2*x*) and the second stop signal (such as stop signal VE2*x*) to the gate circuit 150.

Figure 2:
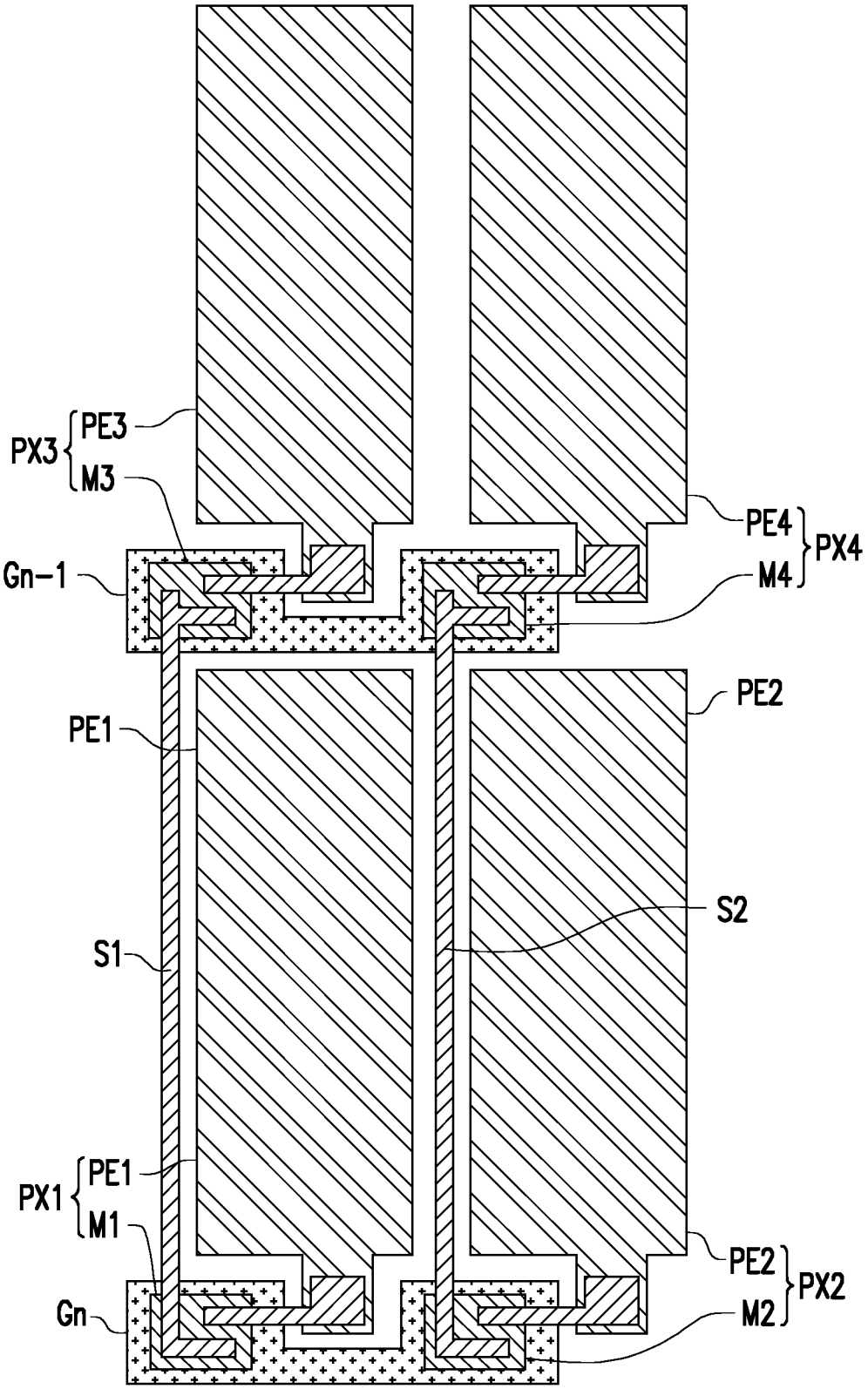
FIG. 2 is a schematic view of a pixel according to an embodiment of the disclosure.

FIG. 2 is a schematic view of a pixel according to an embodiment of the disclosure. Referring to FIG. 1A and FIG. 2, in the embodiment, each of the pixels (such as PX1~PX4) respectively includes a corresponding pixel electrode (such as pixel electrodes PE1 to PE4) and a corresponding pixel switch (such as pixel switch M1~M4). For example, the pixel PX1 may include a pixel switch M1 and a pixel electrode PE1. The pixel PX2 may include a pixel switch M2 and a pixel electrode PE2. The rest may be inferred from FIG. 2, but the embodiment of the disclosure is not limited thereto.

Further, the pixel switches M1 and M2 are respectively coupled between the corresponding pixel electrodes PE1 and PE2 and the commonly corresponding even gate line (such as the gate line Gn). Moreover, the pixel switches M3 and M4 are respectively coupled between the corresponding pixel electrodes PE3 and PE4 and the commonly corresponding odd gate line (such as the gate line Gn−1). Specifically, the pixel switches M1 and M3 are coupled to the same data line 51, and the pixel switches M2 and M4 are coupled to the same data line S2. In the embodiment, the even gate line (such as the gate line Gn) is located, for example, on the second side (e.g., below the pixel electrodes PE1, PE2) of the corresponding pixel electrodes PE1, PE2, and the upper gate line of the even gate line (e.g., gate line Gn) is located, for example, on the first side (e.g., above the pixel electrodes PE1, PE2) of the pixel electrodes PE1, PE2. Moreover, the odd gate line (such as the gate line Gn−1) is located, for example, on the second side (for example, below the pixel electrodes PE3, PE4) of the corresponding pixel electrodes PE3, PE4, and the upper gate line of the odd gate line (e.g., the gate line Gn−1) is located, for example, on the first side (for example, above the pixel electrodes PE3, PE4) of the pixel electrodes PE3, PE4, but the embodiment of the disclosure is not limited thereto. It should be noted that each of the even gate lines (such as the gate line Gn) and each of the odd gate lines (such as the gate line Gn−1) generate a parasitic capacitance between itself and its upper gate line.

Figure 3A:
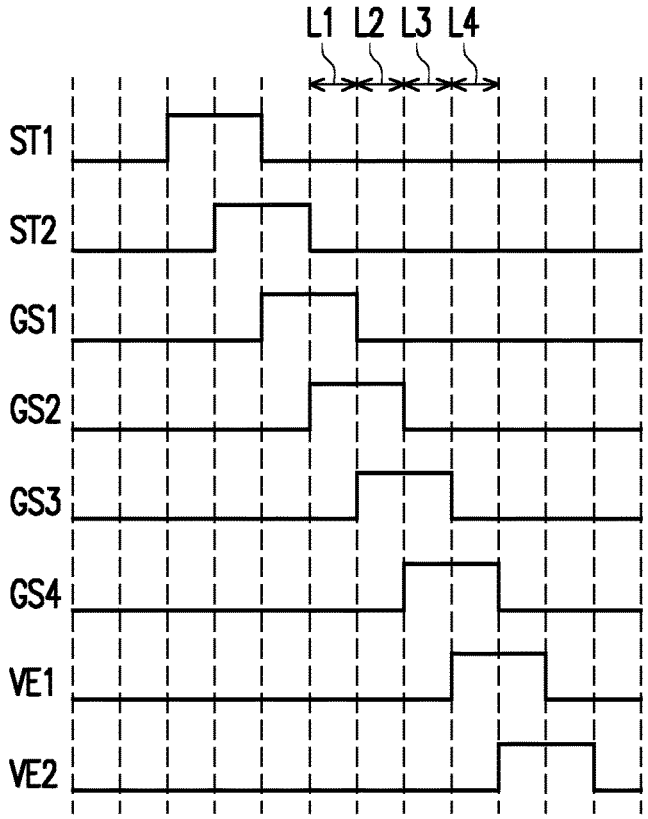
FIG. 3A is a waveform diagram showing each of gate signals in a first scan period according to an embodiment of the disclosure.

FIG. 3A is a waveform diagram showing each of gate signals in a first scan period according to an embodiment of the disclosure. Referring to FIG. 1A, FIG. 2 and FIG. 3A, in the embodiment, it is assumed that the pixel array 130 is driven by two phases, that is, the gate signal (exemplified as GS1 to GS4) at least corresponds to the time (that is, two write time intervals L1~L4) of two gate lines. Moreover, it is assumed that the gate circuit 140 and the gate circuit 150 are operated during the first scan period, that is, the pixel array 130 performs scanning from the first side (above the pixel array 130) to the second side (below the pixel array 130) of the pixel array 130. Moreover, the control end A1_1 and the control end A1_2 of the first gate signal (such as the gate circuit 140) and the second gate circuit (such as the gate circuit 150) may respectively receive the first start signal (such as the start signal ST1) and the second start signal (such as start signal ST2). At the same time, the control end A2_1 and the control end A2_2 of the first gate circuit (such as the gate circuit 140) and the second gate circuit (such as the gate circuit 150) may respectively receive the first stop signal (such as the stop signal VE1) and the second stop signal (such as stop signal VE2).

Moreover, when the even gate line (such as a gate line Gn) or the odd gate line (such as a gate line Gn−1) is located on a second side (for example, below) of a corresponding pixel electrode (such as PE1 to PE4), it represents that when the pixel array 130 performs scanning from top to bottom, each of the pixel electrodes (such as PE1~PE4) only generates feed through voltage once. Moreover, since the upper gate line (the previous gate line) of the pixel electrode (such as PE1~PE4) is located on the first side (for example, above) of the pixel electrode (such as PE1~PE4), the lower gate line (the next gate line) of the pixel electrode (such as PE1~PE4) is not located on the upper and lower sides of the pixel electrode (such as PE1~PE4), so that no parasitic capacitance is generated between the lower gate line (the next gate line) of the pixel electrode and the pixel electrode (such as PE1~PE4). Therefore, it is not necessary to adjust the sequence of the gate signals GS1 to GS4. On this occasion, the gate circuit 140 and the gate circuit 150 provide the sequentially enabled (for example, high voltage level) gate signals GS1 to GS4 to the odd gate line (such as gate line G1, G3) or the even gate line (such as gate line G2, G4).

On this occasion, the pixel array 130 activates the pixels (for example, P11 to PN1, P12 to PN2, P13 to PN3, and P14 to PN4) from the top to the bottom to perform data voltage writing (as shown by write time interval L1~L4) to the activated pixels (for example, P11 to PN1, P12 to PN2, P13 to PN3, P14 to PN4) row by row. Specifically, in the pixel array 130 shown in FIG. 1A, the write time interval L1 corresponds to the write time of the first row of pixels (such as P11 to PN1), and the write time interval L2 corresponds to the write time of the second row of pixels (for example, P12 to PN2), the rest may be inferred from the above.

Figure 3B:
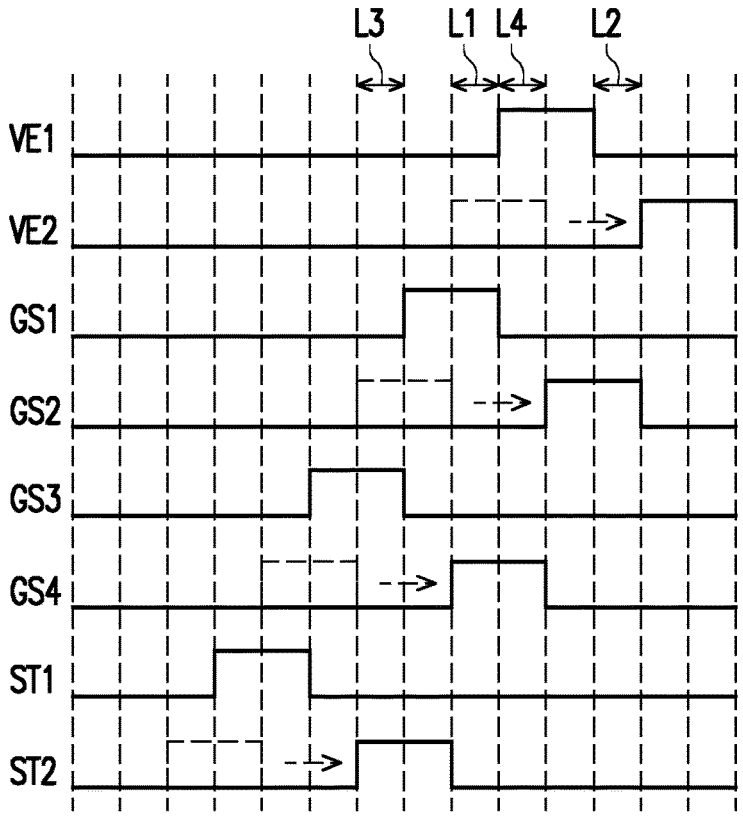
FIG. 3B is a waveform diagram showing each of gate signals in a second scan period according to an embodiment of the disclosure.

FIG. 3B is a waveform diagram showing each of gate signals in a second scan period according to an embodiment of the disclosure. Referring to FIG. 1A, FIG. 2 and FIG. 3B, in the embodiment, it is assumed that the pixel array 130 is driven by two phases, that is, the gate signal (exemplified as GS1 to GS4) at least corresponds to time (that is, two write time intervals L1~L4) of two gate lines. Moreover, it is assumed that the gate circuit 140 and the gate circuit 150 are operated during the second scan period, that is, the pixel array 130 performs scanning from the second side (below the pixel array 130) to the first side (above pixel array 130) of the pixel array 130. Moreover, the control end A1_1 and the control end A1_2 of the first gate circuit (such as the gate circuit 140) and the second gate circuit (such as the gate circuit 150) may respectively receive the first stop signal (such as the stop signal VE1) and the second stop signal (such as stop signal VE2). At the same time, the control end A2_1 and the control end A2_2 of the first gate circuit (such as the gate circuit 140) and the second gate circuit (such as the gate circuit 150) may respectively receive the first start signal (such as the start signal ST1) and the second start signal (such as the start signal ST2).

Moreover, when the even gate line (such as a gate line Gn) or the odd gate line (such as a gate line Gn−1) is located on a second side (for example, below) of a corresponding pixel electrode (such as PE1 to PE4), it represents that each of the pixel electrodes (such as PE1~PE4) generates a secondary feed through voltage when the pixel array 130 performs scanning from bottom to top. Moreover, since the upper gate line (the next gate line) of the pixel electrode (such as PE1~PE4) is located on the first side (for example, above) of the pixel electrode (such as PE1~PE4), the pixel electrode (such as PE1~PE4) generates parasitic capacitance between the even gate line (such as the gate line Gn) and its upper gate line (the next gate line), or generates parasitic capacitance between the odd gate line (such as the gate line Gn−1) and its upper gate line (the next gate line). Therefore, it is necessary to adjust the sequence of the gate signals GS1 to GS4. In the embodiment, the control circuit 110 provides a second start signal (such as the start signal ST2) and a second stop signal (such as the stop signal VE2) that are right-shifted (delayed) by one clock cycle (i.e., four write time intervals L1 to L4), such that the enabling (for example, a high voltage level) sequence of the gate signals GS1 to GS4 provided by the gate circuit 140 and the gate circuit 150 is GS3, GS1, GS4, GS2.

On this occasion, since the gate circuit 150 shifts the corresponding second gate signal (such as the gate signals GS2, GS4) from a preset phase (for example, a time period indicated by dashed line) to the right by one clock cycle (for example, the time period indicated by solid line), the write time interval of the second gate signal (such as the gate signals GS2, GS4) on the even gate line (such as the gate line G2, G4) does not overlap the write time interval of the first gate signal (such as the gate signals GS1, GS3) on the adjacent odd gate line (such as the gate line G1, G3), thus avoiding the secondary feed through voltage.

Figure 4A:
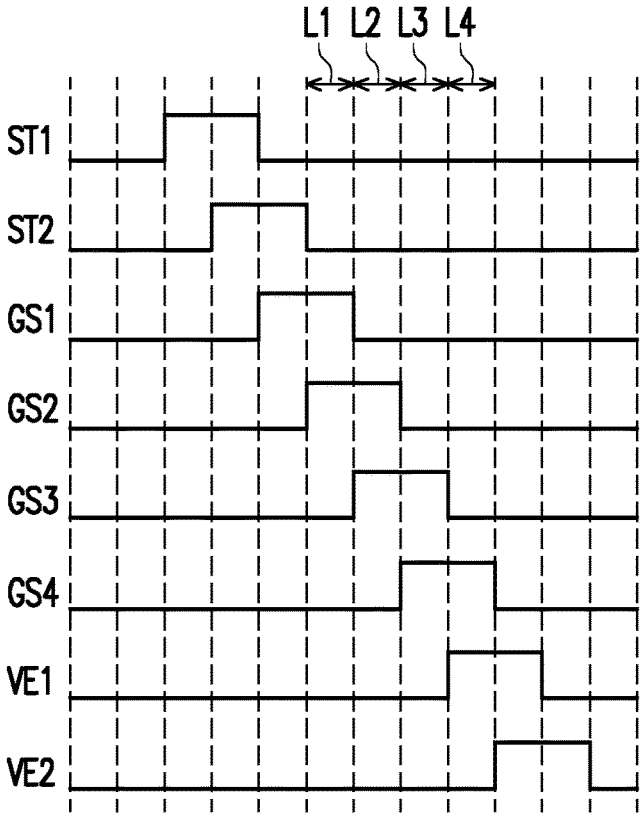
FIG. 4A is a waveform diagram showing each of gate signals in a first scan period according to another embodiment of the disclosure.

FIG. 4A is a waveform diagram showing each of gate signals in a first scan period according to another embodiment of the disclosure. Referring to FIG. 1A and FIG. 4A, in the embodiment, the driving relationship between the gate circuit 140 and the gate circuit 150 with respect to the first gate signal (e.g., the gate signals GS1, GS3) and the second gate signal (such as the gate signals GS2, GS4) when the display panel 120 is operated during the first scan period is the same or similar to the descriptions provided in FIG. 3A, and thus related descriptions are omitted hereafter.

Figure 4B:
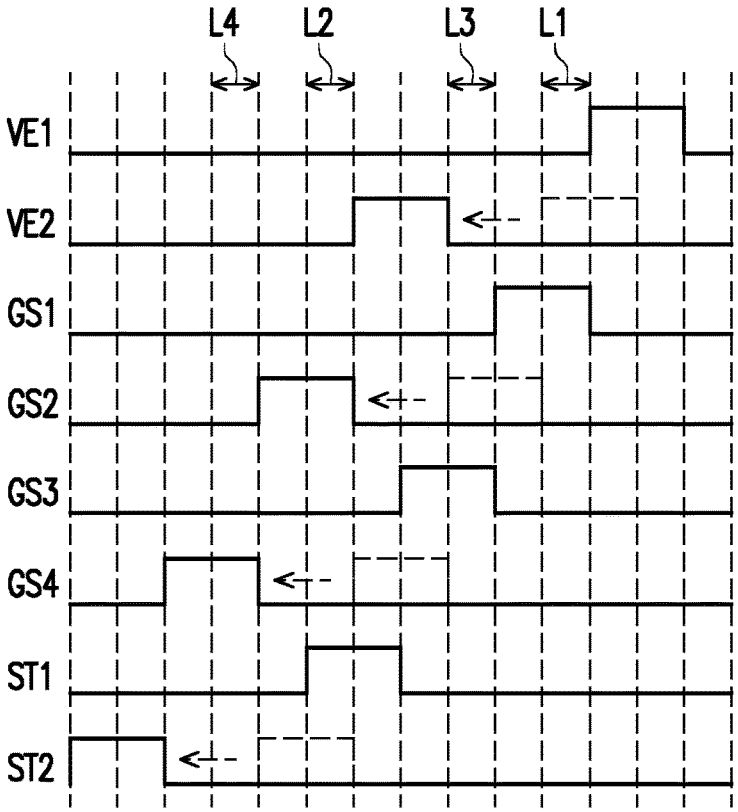
FIG. 4B is a waveform diagram showing each of gate signals in a second scan period according to another embodiment of the disclosure.

FIG. 4B is a waveform diagram showing each of gate signals in a second scan period according to another embodiment of the disclosure. Please refer to FIG. 1A, FIG. 2 and FIG. 4B, in the present embodiment, it is assumed that the pixel array 130 is driven by two phases, that is, the gate signal (exemplified as GS1 to GS4) at least corresponds to the time of two gate lines (that is, two write time intervals L1~L4). Moreover, it is assumed that the gate circuit 140 and the gate circuit 150 are operated during the second scan period, that is, the pixel array 130 performs scanning from the second side (below the pixel array 130) to the first side (above pixel array 130) of the pixel array 130. Moreover, the control end A1_1 and the control end A1_2 of the first gate circuit (such as the gate circuit 140) and the second gate circuit (such as the gate circuit 150) may respectively receive the first stop signal (such as the stop signal VE1) and the second stop signal (such as stop signal VE2). At the same time, the control end A2_1 and the control end A2_2 of the first gate circuit (such as the gate circuit 140) and the second gate circuit (such as the gate circuit 150) may respectively receive the first start signal (such as the start signal ST1) and the second start signal (such as the start signal ST2).

Moreover, when the even gate line (such as a gate line Gn) or the odd gate line (such as a gate line Gn−1) is located on a second side (for example, below) of a corresponding pixel electrode (such as PE1 to PE4), it represents that each of the pixel electrodes (such as PE1~PE4) generates a secondary feed through voltage when the pixel array 130 performs scanning from bottom to top. Moreover, since the upper gate line (the next gate line) of the pixel electrode (such as PE1~PE4) is located on the first side (for example, above) of the pixel electrode (such as PE1~PE4), the pixel electrode (such as PE1~PE4) generates parasitic capacitance between the even gate line (such as the gate line Gn) and its upper gate line (the next gate line), or generates parasitic capacitance between the odd gate line (such as the gate line Gn−1) and its upper gate line (the next gate line). Therefore, it is necessary to adjust the sequence of the gate signals GS1 to GS4. In the embodiment, the control circuit 110 provides a second start signal (such as the start signal ST2) and a second stop signal (such as the stop signal VE2) that are left-shifted (advanced) by one clock cycle (i.e., four write time intervals L1 to L4), such that the enabling (for example, a high voltage level) sequence of the gate signals GS1 to GS4 provided by the gate circuit 140 and the gate circuit 150 is GS4, GS2, GS3, GS1.

On this occasion, since the gate circuit 150 shifts the corresponding second gate signal (such as the gate signals GS2, GS4) from a preset phase (for example, a time period indicated by dashed line) to the left by one clock cycle (for example, the time period indicated by solid line), the write time interval of the second gate signal (such as the gate signals GS2, GS4) on the even gate line (such as the gate line G2, G4) does not overlap the write time interval of the first gate signal (such as the gate signals GS1, GS3) on the adjacent odd gate line (such as the gate line G1, G3), thus avoiding the secondary feed through voltage.

Figure 5A:
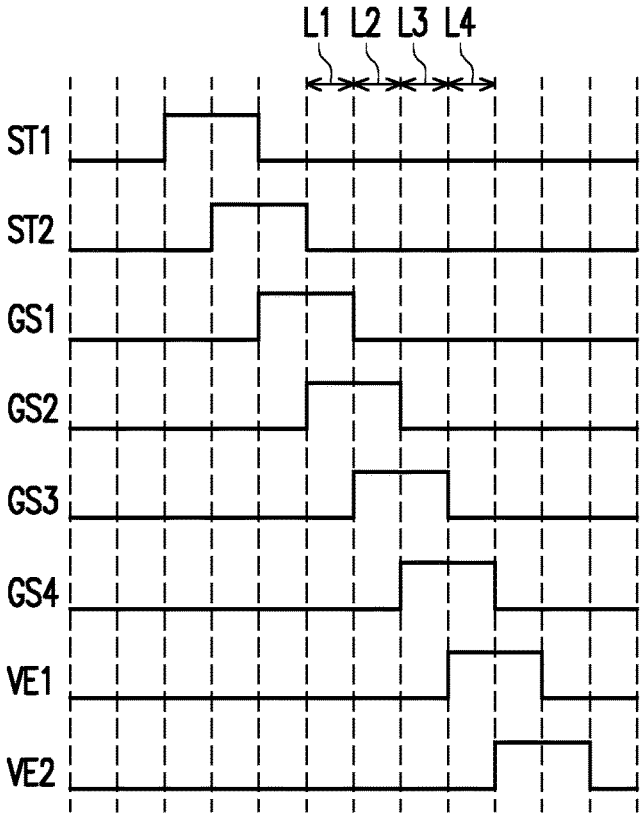
FIG. 5A is a waveform diagram showing each of gate signals in a first scan period according to yet another embodiment of the disclosure.

FIG. 5A is a waveform diagram showing each of gate signals in a first scan period according to yet another embodiment of the disclosure. Referring to FIG. 1A and FIG. 5A, in the embodiment, the driving relationship between the gate circuit 140 and the gate circuit 150 with respect to the first gate signal (e.g., the gate signals GS1, GS3) and the second gate signal (such as the gate signals GS2, GS4) when the display panel 120 is operated during the first scan period is the same or similar to the descriptions provided in FIG. 3A, and thus related descriptions are omitted hereafter.

Figure 5B:
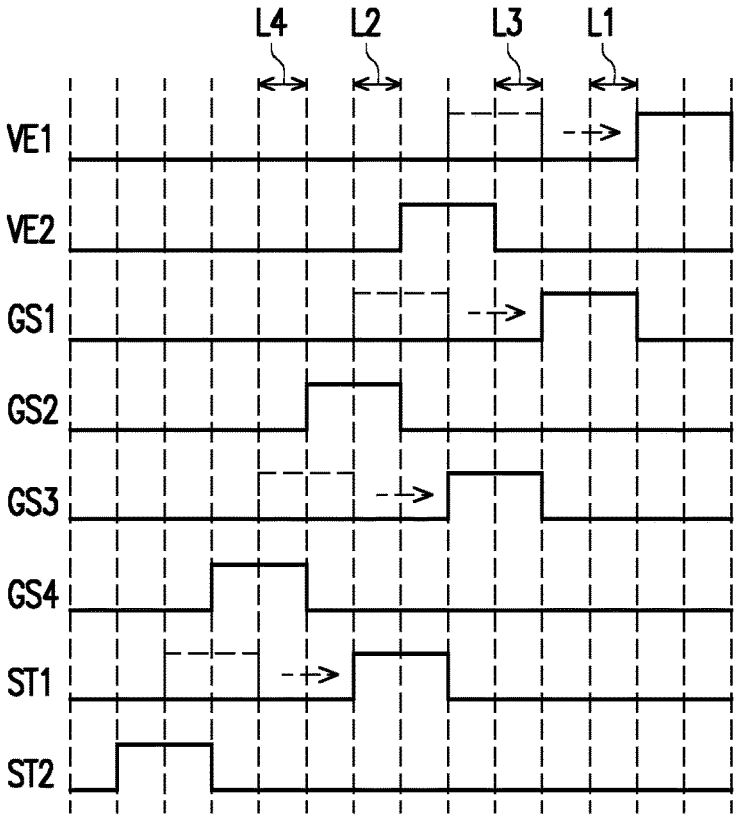
FIG. 5B is a waveform diagram showing each of gate signals in a second scan period according to still another embodiment of the disclosure.

FIG. 5B is a waveform diagram showing each of gate signals in a second scan period according to still another embodiment of the disclosure. Please refer to FIG. 1A, FIG. 2 and FIG. 5B, in the present embodiment, it is assumed that the pixel array 130 is driven by two phases, that is, the gate signal (exemplified as GS1 to GS4) at least corresponds to the time of two gate lines (that is, two write time intervals L1~L4). Moreover, it is assumed that the gate circuit 140 and the gate circuit 150 are operated during the second scan period, that is, the pixel array 130 performs scanning from the second side (below the pixel array 130) to the first side (above pixel array 130) of the pixel array 130. Moreover, the control end A1_1 and the control end A1_2 of the first gate circuit (such as the gate circuit 140) and the second gate circuit (such as the gate circuit 150) may respectively receive the first stop signal (such as the stop signal VE1) and the second stop signal (such as stop signal VE2). At the same time, the control end A2_1 and the control end A2_2 of the first gate circuit (such as the gate circuit 140) and the second gate circuit (such as the gate circuit 150) may respectively receive the first start signal (such as the start signal ST1) and the second start signal (such as the start signal ST2).

Moreover, when the even gate line (such as a gate line Gn) or the odd gate line (such as a gate line Gn−1) is located on a second side (for example, below) of a corresponding pixel electrode (such as PE1 to PE4), it represents that each of the pixel electrodes (such as PE1~PE4) generates a secondary feed through voltage when the pixel array 130 performs scanning from bottom to top. Moreover, since the upper gate line (the next gate line) of the pixel electrode (such as PE1~PE4) is located on the first side (for example, above) of the pixel electrode (such as PE1~PE4), the pixel electrode (such as PE1~PE4) generates parasitic capacitance between the even gate line (such as the gate line Gn) and its upper gate line (the next gate line), or generates parasitic capacitance between the odd gate line (such as the gate line Gn−1) and its upper gate line (the next gate line). Therefore, it is necessary to adjust the sequence of the gate signals GS1 to GS4. In the embodiment, the control circuit 110 provides a first start signal (such as the start signal ST1) and a first stop signal (such as the stop signal VE1) that are right-shifted (delayed) by one clock cycle (i.e., four write time intervals L1 to L4), such that the enabling (for example, a high voltage level) sequence of the gate signals GS1 to GS4 provided by the gate circuit 140 and the gate circuit 150 is GS4, GS2, GS3, GS1.

On this occasion, since the gate circuit 140 shifts the corresponding first gate signal (such as the gate signals GS1, GS3) from a preset phase (for example, a time period indicated by dashed line) to the right by one clock cycle (for example, the time period indicated by solid line), the write time interval of the first gate signal (such as the gate signals GS1, GS3) on the odd gate line (such as the gate line G1, G3) does not overlap the write time interval of the second gate signal (such as the gate signals GS2, GS4) on the adjacent even gate line (such as the gate line G2, G4), thus avoiding the secondary feed through voltage.

Figure 6A:
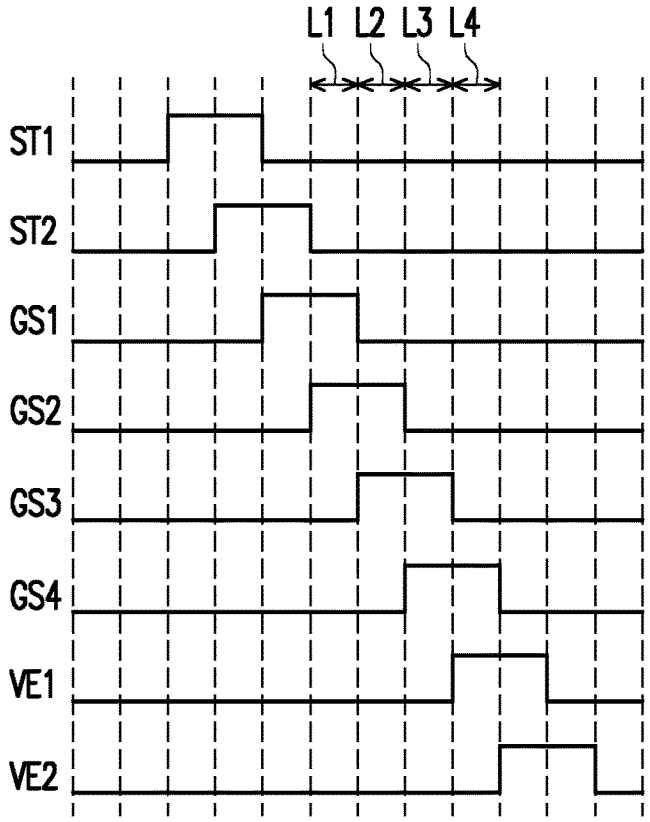
FIG. 6A is a waveform diagram showing each of gate signals in a first scan period according to yet another embodiment of the disclosure.

FIG. 6A is a waveform diagram showing each of gate signals in a first scan period according to yet another embodiment of the disclosure. Referring to FIG. 1A and FIG. 6A, in the embodiment, the driving relationship between the gate circuit 140 and the gate circuit 150 with respect to the first gate signal (e.g., the gate signals GS1, GS3) and the second gate signal (such as the gate signals GS2, GS4) when the display panel 120 is operated during the first scan period is the same or similar to the descriptions provided in FIG. 3A, and thus related descriptions are omitted hereafter.

Figure 6B:
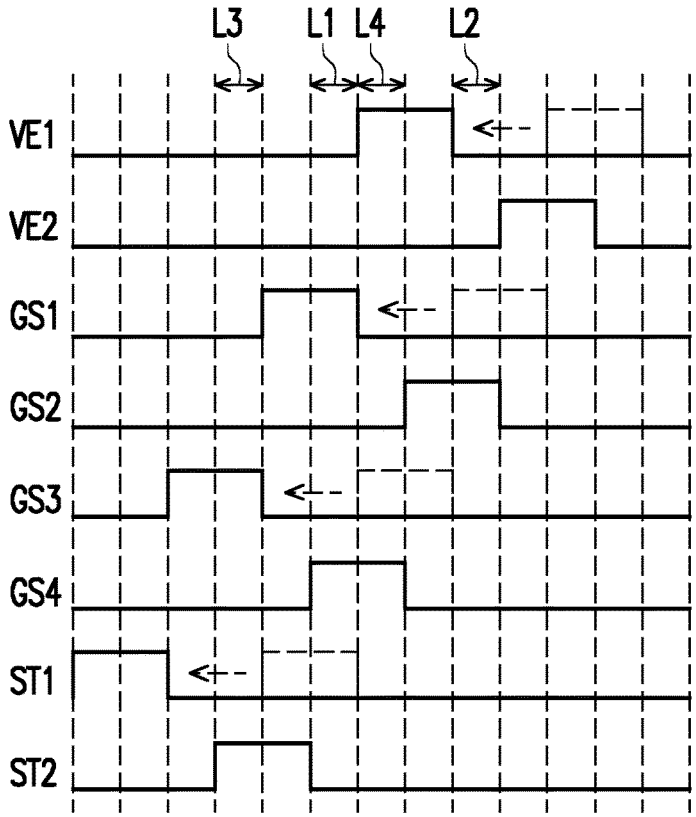
FIG. 6B is a waveform diagram showing each of gate signals in a second scan period according to still another embodiment of the disclosure.

FIG. 6B is a waveform diagram showing each of gate signals in a second scan period according to still another embodiment of the disclosure. Please refer to FIG. 1A, FIG. 2 and FIG. 6B, in the present embodiment, it is assumed that the pixel array 130 is driven by two phases, that is, the gate signal (exemplified as GS1 to GS4) at least corresponds to the time of two gate lines (that is, two write time intervals L1~L4). Moreover, it is assumed that the gate circuit 140 and the gate circuit 150 are operated during the second scan period, that is, the pixel array 130 performs scanning from the second side (below the pixel array 130) to the first side (above pixel array 130) of the pixel array 130. Moreover, the control end A1_1 and the control end A1_2 of the first gate circuit (such as the gate circuit 140) and the second gate circuit (such as the gate circuit 150) may respectively receive the first stop signal (such as the stop signal VE1) and the second stop signal (such as stop signal VE2). At the same time, the control end A2_1 and the control end A2_2 of the first gate circuit (such as the gate circuit 140) and the second gate circuit (such as the gate circuit 150) may respectively receive the first start signal (such as the start signal ST1) and the second start signal (such as the start signal ST2).

Moreover, when the even gate line (such as a gate line Gn) or the odd gate line (such as a gate line Gn−1) is located on a second side (for example, below) of a corresponding pixel electrode (such as PE1 to PE4), it represents that each of the pixel electrodes (such as PE1~PE4) generates a secondary feed through voltage when the pixel array 130 performs scanning from bottom to top. Moreover, since the upper gate line (the next gate line) of the pixel electrode (such as PE1~PE4) is located on the first side (for example, above) of the pixel electrode (such as PE1~PE4), the pixel electrode (such as PE1~PE4) generates parasitic capacitance between the even gate line (such as the gate line Gn) and its upper gate line (the next gate line), or generates parasitic capacitance between the odd gate line (such as the gate line Gn−1) and its upper gate line (the next gate line). Therefore, it is necessary to adjust the sequence of the gate signals GS1 to GS4. In the embodiment, the control circuit 110 provides a first start signal (such as the start signal ST1) and a first stop signal (such as the stop signal VE1) that are left-shifted (advanced) by one clock cycle (i.e., four write time intervals L1 to L4), such that the enabling (for example, a high voltage level) sequence of the gate signals GS1 to GS4 provided by the gate circuit 140 and the gate circuit 150 is GS3, GS1, GS4, GS2.

On this occasion, since the gate circuit 140 shifts the corresponding first gate signal (such as the gate signals GS1, GS3) from a preset phase (for example, a time period indicated by dashed line) to the left by one clock cycle (for example, the time period indicated by solid line), the write time interval of the first gate signal (such as the gate signals GS1, GS3) on the odd gate line (such as the gate line G1, G3) does not overlap the write time interval of the second gate signal (such as the gate signals GS2, GS4) on the adjacent even gate line (such as the gate line G2, G4), thus avoiding the secondary feed through voltage.

In the above various embodiments, in the second scan period, the function of the first start signal (such as the start signal ST1) and the second start signal (such as the start signal ST2) plus time is as follows: ST2($t$−vst_R)=ST1($t$−Vst_L), t represents time. Moreover, the phase relationship between the first start signal (such as the start signal ST1) and the second start signal (such as the start signal ST2) is as follows: vst_R=Vst_L+(m−0.5)*C_CLK, wherein the above vst_R represents the start time point of the second start signal (such as the start signal ST2), Vst_L represents the start time point of the first start signal (such as the start signal ST1), C_CLK represents the clock cycle, and m is a random integer not equal to 0. The function of the first stop signal (such as stop signal VE1) and the second stop signal (such as stop signal VE2) plus time is as follows: VE1 (t−Vend_L)=VE2 (t−Vend_R), and the phase relationship between the first stop signal (such as stop signal VE1) and the second stop signal (such as stop signal VE2) is vend_R=vend_L+(m−0.5)*C_CLK, and m is a random integer not equal to 0.

In the first scan period, the phase difference between the phase of the first start signal (such as the start signal ST1) and the phase of the second start signal (such as the start signal ST2) is equal to a horizontal scan period (which is equal to ½ clock cycle herein), that is, vst_R=Vst_L+0.5*C_CLK. Moreover, the phase difference between the phase of the first stop signal (such as the stop signal VE1) and the phase of the second stop signal (such as the stop signal VE2) in the first scan period is equal to a horizontal scan period (which is equal to ½ clock cycle herein), that is, vend_R=vend_L+0.5*C_CLK.

Figure 7A:
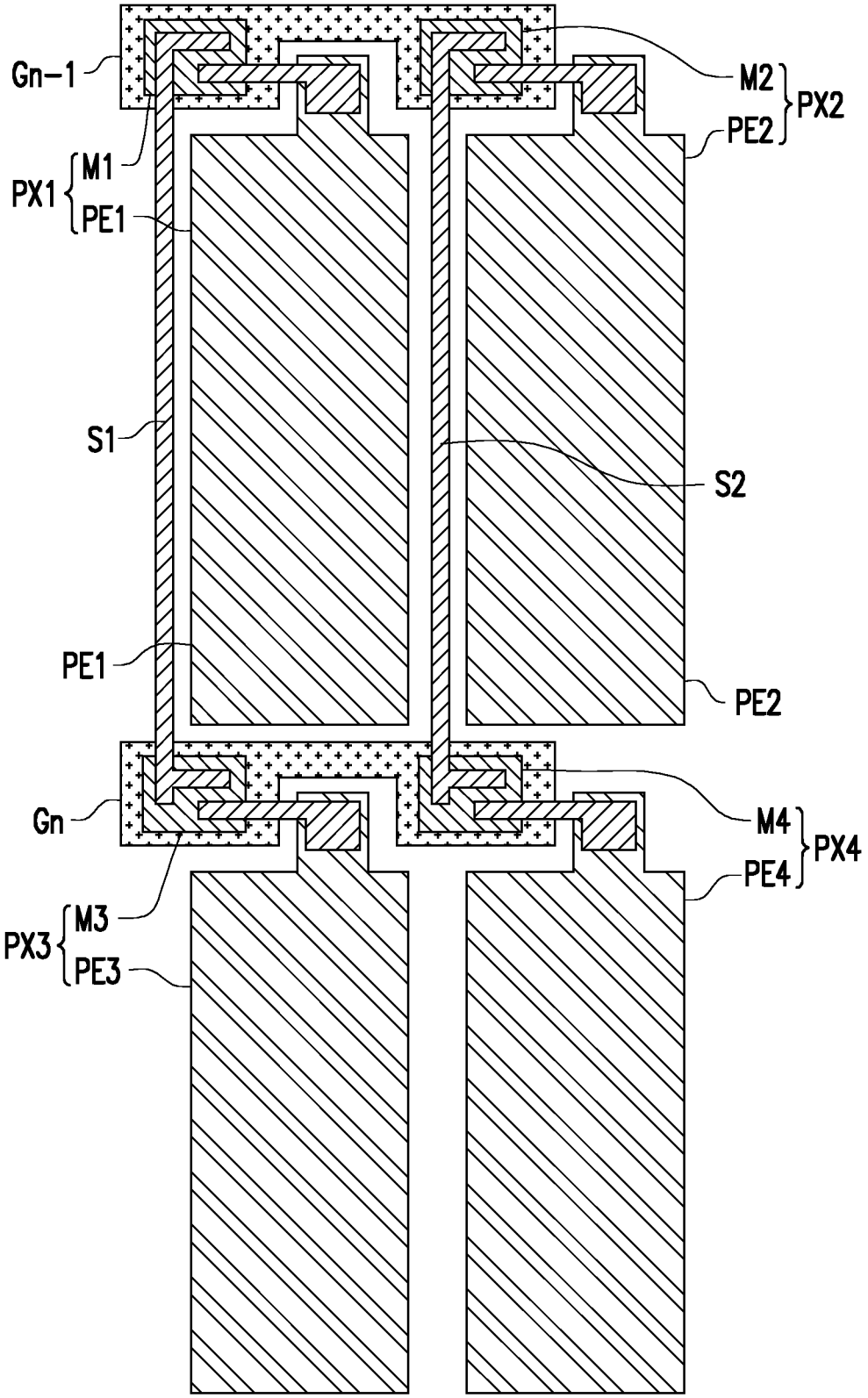
FIG. 7A is a schematic view of a pixel according to still another embodiment of the disclosure.

FIG. 7A is a schematic view of a pixel according to still another embodiment of the disclosure. Referring to FIG. 1A, FIG. 2 and FIG. 7A, in the embodiment, the corresponding pixel electrodes (such as pixel electrodes PE1 to PE4) and corresponding pixel switches (for example, the pixel switches M1 to M4) in each of the pixels (such as PX1~PX4) are substantially the same as the corresponding pixel electrodes (such as the pixel electrodes PE1 to PE4) and the corresponding pixel switches (such as pixel switches M1 to M4) of each of the pixels (such as PX1 to PX4) in FIG. 2, wherein the same or similar elements are denoted by the same or similar reference numerals. Different from the previous embodiment, in the present embodiment, the odd gate line (such as the gate line Gn−1) is located, for example, on the first side (for example, above pixel electrodes PE1, PE2) of the corresponding pixel electrodes PE1, PE2, and the even gate line (such as the gate line Gn) is located, for example, on the first side (e.g., above the pixel electrodes PE3, PE4) of the corresponding pixel electrodes PE3, PE4, but the embodiment of the disclosure is not limited thereto.

In addition, since the lower gate line of the pixel electrode (e.g., the pixel electrodes PE1 to PE4) is located on the second side (for example, below) of the pixel electrode (e.g., the pixel electrodes PE1 to PE4), the pixel electrode (e.g., pixel electrodes PE1 to PE4) generates parasitic capacitance between the even gate line (such as the gate line Gn) and its lower gate line, or generates parasitic capacitance between the odd gate line (such as the gate line Gn−1) and its lower gate line.

Figure 7B:
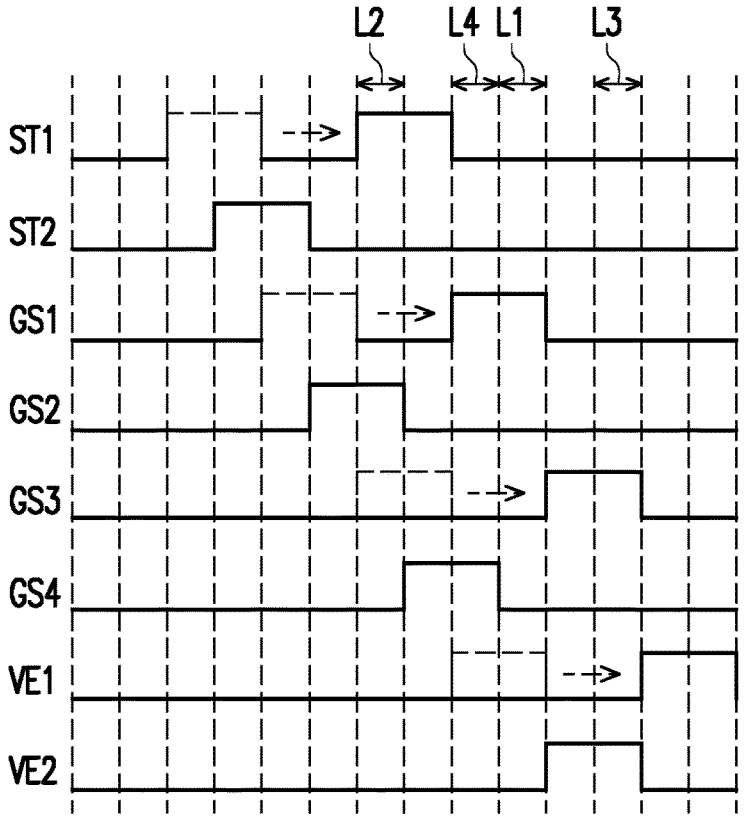
FIG. 7B is a waveform diagram showing each of gate signals in a first scan period according to yet another embodiment of the disclosure.

FIG. 7B is a waveform diagram showing each of gate signals in a first scan period according to yet another embodiment of the disclosure. Please refer to FIG. 1A, FIG. 7A and FIG. 7B, in the present embodiment, it is assumed that the pixel array 130 is driven by two phases, that is, the gate signal (exemplified as GS1 to GS4) at least corresponds to the time of two gate lines (that is, two write time intervals L1~L4). Moreover, it is assumed that the gate circuit 140 and the gate circuit 150 are operated during the first scan period, that is, the pixel array 130 performs scanning from the first side (above the pixel array 130) to the second side (below pixel array 130) of the pixel array 130.

Moreover, when the even gate line (such as a gate line Gn) or the odd gate line (such as a gate line Gn−1) is located on a first side (for example, above) of a corresponding pixel electrode (such as PE1 to PE4), it represents that each of the pixel electrodes (such as PE1~PE4) generates a secondary feed through voltage when the pixel array 130 performs scanning from top to bottom. Moreover, since the lower gate line (the next gate line) of the pixel electrode (such as PE1~PE4) is located on the second side (for example, below) of the pixel electrode (such as PE1~PE4), the pixel electrode (such as PE1~PE4) generates parasitic capacitance between the even gate line (such as the gate line Gn) and its lower gate line (the next gate line), or generates parasitic capacitance between the odd gate line (such as the gate line Gn−1) and its lower gate line (the next gate line). Therefore, it is necessary to adjust the sequence of the gate signals GS1 to GS4. In the embodiment, the control circuit 110 provides a first start signal (such as the start signal ST1) and a first stop signal (such as the stop signal VE1) that are right-shifted (delayed) by one clock cycle (i.e., four write time intervals L1 to L4), such that the enabling (for example, a high voltage level) sequence of the gate signals GS1 to GS4 provided by the gate circuit 140 and the gate circuit 150 is GS2, GS4, GS1, GS3.

On this occasion, since the gate circuit 140 shifts the corresponding first gate signal (such as the gate signals GS1, GS3) from a preset phase (for example, a time period indicated by dashed line) to the right by one clock cycle (for example, the time period indicated by solid line), the write time interval of the first gate signal (such as the gate signals GS1, GS3) on the odd gate line (such as the gate line G1, G3) does not overlap the write time interval of the second gate signal (such as the gate signals GS2, GS4) on the adjacent even gate line (such as the gate line G2, G4), thus avoiding the secondary feed through voltage.

Figure 7C:
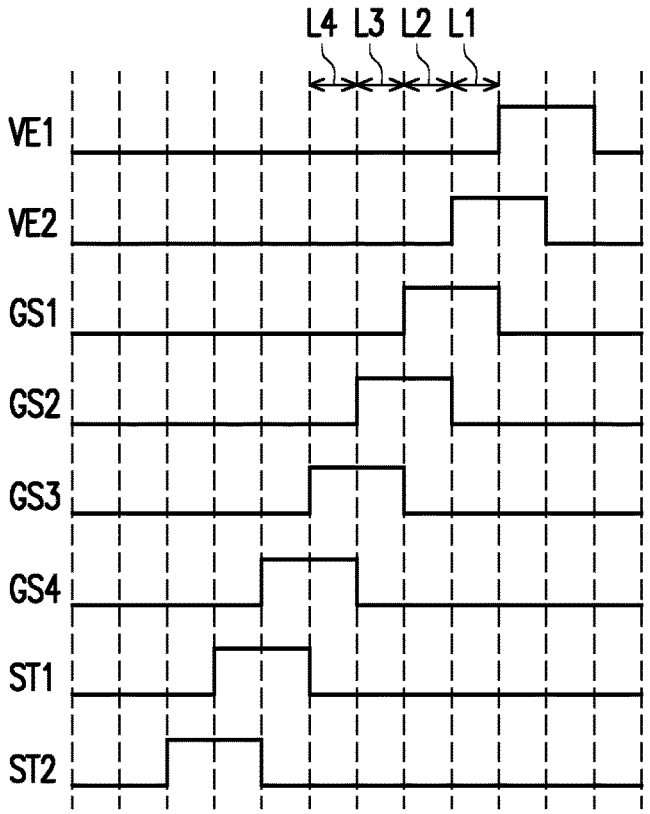
FIG. 7C is a waveform diagram showing each of gate signals in a second scan period according to still another embodiment of the disclosure.

FIG. 7C is a waveform diagram showing each of gate signals in a second scan period according to still another embodiment of the disclosure. Please refer to FIG. 1A, FIG. 7A and FIG. 7C, in the present embodiment, it is assumed that the pixel array 130 is driven by two phases, that is, the gate signal (exemplified as GS1 to GS4) at least corresponds to the time of two gate lines (that is, two write time intervals L1~L4). Moreover, it is assumed that the gate circuit 140 and the gate circuit 150 are operated during the second scan period, that is, the pixel array 130 performs scanning from the second side (below the pixel array 130) to the first side (above pixel array 130) of the pixel array 130.

Moreover, when the even gate line (such as a gate line Gn) or the odd gate line (such as a gate line Gn−1) is located on a first side (for example, above) of a corresponding pixel electrode (such as PE1 to PE4), it represents that each of the pixel electrodes (such as PE1~PE4) only generates the feed through voltage once when the pixel array 130 performs scanning from bottom to top. Moreover, since the upper gate line (the next gate line) of the pixel electrode (such as PE1~PE4) is not located on the upper and lower sides of the pixel electrode (such as PE1~PE4), the parasitic capacitance is not generated between the upper gate line (the next gate line) and the pixel electrode (such as PE1~PE4). Therefore, it is not necessary to adjust the sequence of the gate signals GS1 to GS4. On this occasion, the gate circuit 140 and the gate circuit 150 provide the sequentially enabled (for example, high voltage level) gate signals GS1 to GS4 to the odd gate line (such as gate line G1, G3) or the even gate line (such as gate line G2, G4).

On this occasion, the pixel array 130 activates the pixels (for example, P14 to PN4, P13 to PN3, P12 to PN2, and P11 to PN1) from the bottom to the top to perform data voltage writing (as shown by write time interval L1~L4) to the activated pixels (e.g., P14 to PN4, P13 to PN3, P12 to PN2, and P11 to PN1) row by row. Specifically, in the pixel array 130 shown in FIG. 1A, the write time interval L1 corresponds to the write time of the first row of pixels (such as P11 to PN1), and the write time interval L2 corresponds to the write time of the second row of pixels (for example, P12 to PN2), the rest may be inferred from the above.

In the above embodiment, in the first scan period, the function of the first start signal (such as the start signal ST1) and the second start signal (such as the start signal ST2) plus time is as follows: ST2(t-vst_R)=ST1(*t*-Vst_L), t represents time. Moreover, the phase relationship between the first start signal (such as the start signal ST1) and the second start signal (such as the start signal ST2) is as follows: vst_R=Vst_L+(m+0.5)*C_CLK, wherein the above vst_R represents the start time point of the second start signal (such as the start signal ST2), Vst_L represents the start time point of the first start signal (such as the start signal ST1), C_CLK represents the clock cycle, and m is a random integer not equal to 0. The function of the first stop signal (such as stop signal VE1) and the second stop signal (such as stop signal VE2) plus time is as follows: VE1 (t−Vend_L)=VE2 (t−Vend_R), and the phase relationship between the first stop signal (such as stop signal VE1) and the second stop signal (such as stop signal VE2) is vend_R=vend_L+(m+0.5) *C_CLK, and m is a random integer not equal to 0.

In the second scan period, the phase difference between the phase of the first start signal (such as the start signal ST1) and the phase of the second start signal (such as the start signal ST2) is equal to a horizontal scan period (which is equal to ½ clock cycle herein), that is, vst_R=Vst_L−0.5*C_CLK. Moreover, the phase difference between the phase of the first stop signal (such as the stop signal VE1) and the phase of the second stop signal (such as the stop signal VE2) in the second scan period is equal to a horizontal scan period (which is equal to ½ clock cycle herein), that is, vend_R=vend_L−0.5*C_CLK.

In the above various embodiments, the pixel array 130 of the disclosure may be driven by 2, 4 or 8 phases, and the disclosure is not limited to the number of phases exemplified above.

Figure 8:
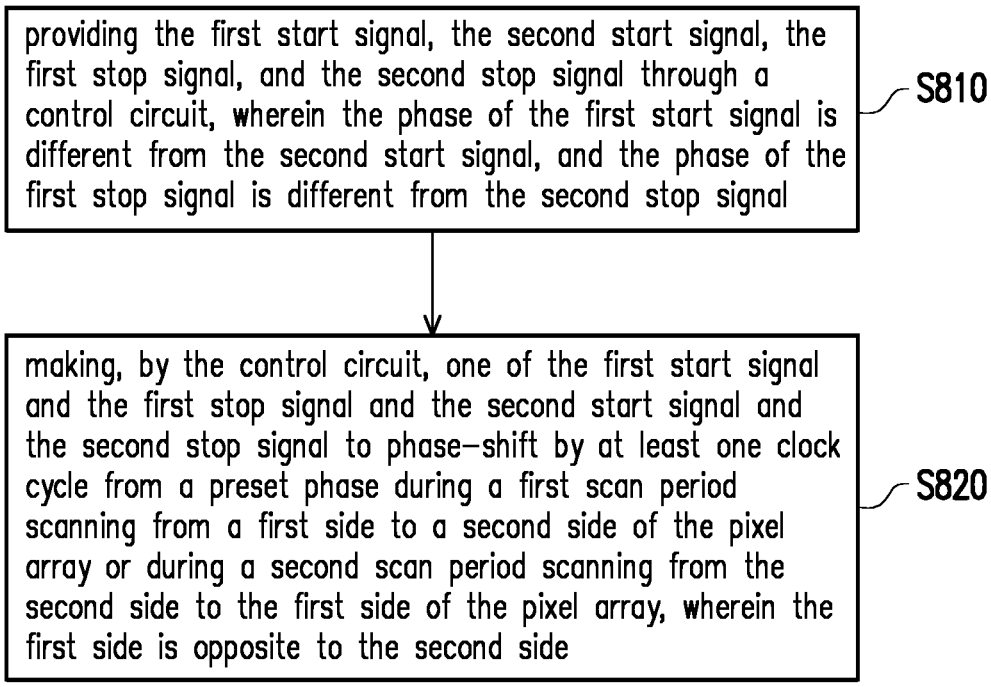
FIG. 8 is a flowchart diagram showing a driving method of a display panel according to an embodiment of the disclosure.

FIG. 8 is a flowchart diagram showing a driving method of a display panel according to an embodiment of the disclosure. Referring to FIG. 8, in the embodiment, the pixel array has a plurality of odd gate lines and a plurality of even gate lines. The first gate circuit may provide a plurality of sequentially enabled first gate signals to the odd gate lines according to the phases of the first start signal and the first stop signal. The second gate circuit may provide a plurality of sequentially enabled second gate signals to the even gate lines according to the phases of the second start signal and the second stop signal. In step S810, the display device may provide the first start signal, the second start signal, the first stop signal, and the second stop signal through the control circuit, wherein the phase of the first start signal is different from the second start signal, and the phase of the first stop signal is different from the second stop signal. In step S820, the display device may make, through the control circuit, one of the first start signal and the first stop signal as well as the second start signal and the second stop signal to shift by at least one clock cycle from a preset phase during a first scan period that scans from the first side to the second side of the pixel array or during a second scan period that scans from the second side to the first side of the pixel array, wherein the first side is opposite to the second side.

The implementation of each step have been described in details in the foregoing embodiments and implementations, and related descriptions are omitted hereafter.

Figure 9:
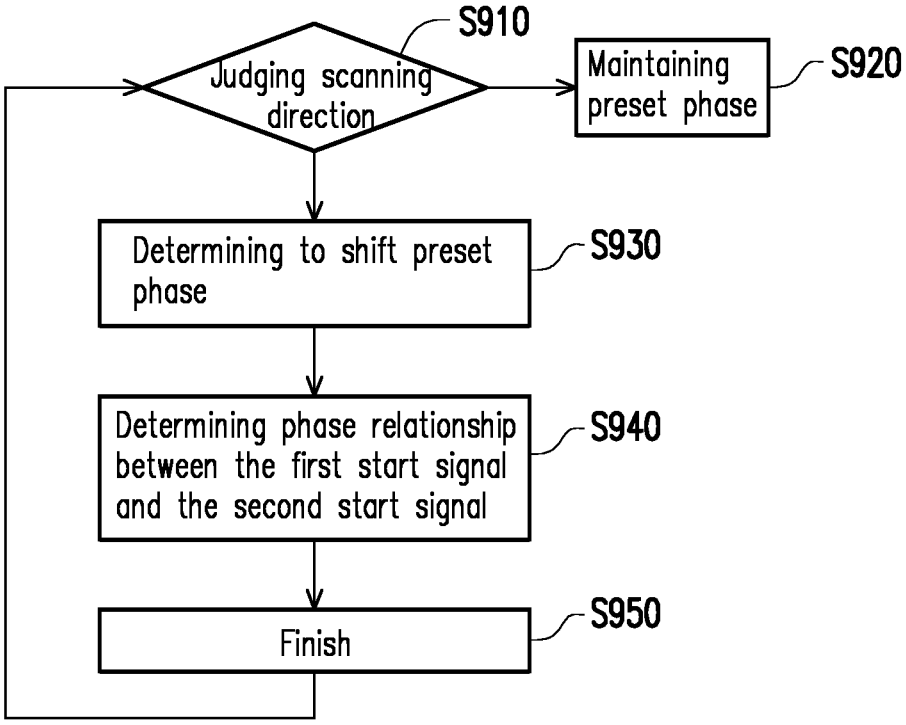
FIG. 9 is a flowchart diagram showing a method of shifting a preset phase according to an embodiment of the disclosure.

FIG. 9 is a flowchart diagram showing a method of shifting a preset phase according to an embodiment of the disclosure. Referring to FIG. 1A and FIG. 9, in step S910, the control circuit 110 may determine whether the display device 100 is operated during the first scan period or the second scan period to determine whether the first start signal or the second start signal needs to be phase-shifted. If the control circuit 110 determines that the first start signal or the second start signal does not need to be phase-shifted, the control circuit 110 performs step S920; otherwise, the display device 100 performs step S930.

In step S920, the control circuit 110 may set the phases of the first start signal and the first stop signal as well as the second start signal and the second stop signal to be maintained at a preset phase, that is, the first start signal and the first stop signal or the second start signal and the second stop signal are not phase-shifted. In step 930, the control circuit 110 may determine to shift the first start signal and the first stop signal or the second start signal and the second stop signal by one clock cycle from the preset phase, such that one of the first gate signal and the second gate signal is shifted by one clock cycle from the preset phase.

Next, in step S940, the control circuit 110 may determine that the phase relationship between the first start signal (such as the start signal ST1) and the second start signal (such as the start signal ST2) is vst_R=Vst_L+(m±0.5)*C_CLK or vst_R=Vst_L−(m±0.5)*C_CLK, wherein vst_R represents the start time point of the second start signal (such as the start signal ST2), and Vst_L represents the start time point of the first start signal (such as the start signal ST1), C_CLK represents the clock cycle, and m is an integer not equal to 0. Moreover, the phase relationship between the first stop signal (such as the stop signal VE1) and the second stop signal (such as the stop signal VE2) is vend_R=vend_L+(m±0.5)*C_CLK, and m is an integer not equal to 0. Next, in step S950, the display device 100 ends the operation step of shifting the preset phase, and performs step S910.

In summary, the display device of the disclosure is capable of using the control circuit to perform scanning on the pixel array through the first start signal and the first stop signal or the second start signal and the second stop signal when operating in the first scan period or the second scan period. Moreover, the control circuit may make the first start signal and the first stop signal or the second start signal and the second stop signal to phase-shift by at least one clock cycle from a preset phase according to the scanning direction along which the pixel array is scanned by the first start signal and the first stop signal or the second start signal and the second stop signal, such that the corresponding first gate signal or the second gate signal is phase-shifted by at least one clock cycle from a preset phase. In this manner, the feed through voltage of the pixels in the pixel array of the disclosure can be consistent, thereby improving display quality of the display panel.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A display device, comprising:

a control circuit, providing a first start signal, a second start signal, a first stop signal, and a second stop signal; and a display panel, comprising:

a pixel array, having a plurality gate lines, which are divided into a plurality of odd gate lines and a plurality of even gate lines;

a first gate circuit, providing a plurality of sequentially enabled first gate signals to the odd gate lines according to phases of the first start signal and the first stop signal respectively received from a first control end and a second control end of the first gate circuit; and a second gate circuit, providing a plurality of sequentially enabled second gate signals to the even gate lines according to phases of the second start signal and the second stop signal respectively received from a third control end and a fourth control end of the second gate circuit;

wherein during a first scan period, enabled times of the first gate signals and the second gate signals are provided to a first side of the pixel array, the gate signals received by adjacent gate lines are partially overlapped; and wherein during a second scan period, enabled times of the first gate signals and the second gate signals are provided to a second side opposite to the first side of the pixel array, the gate signals received by adjacent gate lines are not overlapped.

2. The display device according to claim 1, wherein one of the first start signal and the second start signal is phase-shifted forward, and one of the first stop signal and the second stop signal is phase-shifted forward.

3. The display device according to claim 1, wherein one of the first start signal and the second start signal is phase-shifted backward, and one of the first stop signal and the second stop signal is phase-shifted backward.

4. The display device according to claim 1, wherein the pixel array further comprises a plurality of pixels respectively coupled to the odd gate lines and the even gate lines.

5. The display device according to claim 4, wherein each of the pixels comprises:

a pixel electrode;

a pixel switch, coupled between the pixel electrode and the corresponding odd gate line or the corresponding even gate line.

6. The display device according to claim 5, wherein when the corresponding odd gate line or the even gate line is located on the second side of the pixel electrode, one of the first start signal and the first stop signal and the second start signal and the second stop signal are phase-shifted by at least one clock cycle from the preset phase in the second scan period.

7. The display device according to claim 6, wherein a phase relationship between the first start signal and the second start signal in the second scan period is vst_R=Vst_L+(m−0.5)*C_CLK, wherein vst_R is a start time point of the second start signal, Vst_L is a start time point of the first start signal, C_CLK is a clock cycle, and m is a random integer not equal to 0.

8. The display device according to claim 5, wherein when the corresponding odd gate line or the even gate line is located on the first side of the pixel electrode, one of the first start signal and the first stop signal and the second start signal and the second stop signal are phase-shifted by at least one clock cycle from the preset phase in the first scan period.

9. The display device according to claim 8, wherein a phase relationship between the first start signal and the second start signal in the first scan period is vst_R=Vst_L+(m+0.5)*C_CLK, wherein vst_R is a start time point of the second start signal, Vst_L is a start time point of the first start signal, C_CLK is a clock cycle, and m is a random integer not equal to 0.

10. The display device according to claim 1, wherein the control circuit comprises:

a multiplexer, having an input end receiving a scan start signal, a first output end providing a first trigger signal, a second output end providing a second trigger signal, and a control end receiving a scan direction control signal;

a control logic, receiving the scan start signal, and coupled to the first output end and the second output end, thereby providing a shift control signal shifting the first start signal and the first stop signal or the second start signal and the second stop signal; and a shift logic, coupled to the control logic to receive the shift control signal, thereby providing the shifted first start signal and the first stop signal or the second start signal and the second stop signal and the second start signal and the second stop signal or the first start signal and the first stop signal.

11. The display device according to claim 1, wherein a phase difference between the phase of the first start signal and the phase of the second start signal is equal to a horizontal scan period.

12. A driving method of a display panel, the display panel comprising a pixel array having a plurality gate lines, which are divided into a plurality of odd gate lines and a plurality of even gate lines, a first gate circuit providing a plurality of sequentially enabled first gate signals to the odd gate lines according to phases of a first start signal and a first stop signal, and a second gate circuit providing a plurality of sequentially enabled second gate signals to the even gate lines according to phases of a second start signal and a second stop signal, the driving method comprising:

during a first scan period, providing the first gate signals and the second gate signals to a first side of the pixel array, enabled times of the gate signals received by adjacent gate lines are partially overlapped; and during a second scan period, providing the first gate signals and the second gate signals to a second side of the pixel array, enabled times of the gate signals received by adjacent gate lines are not overlapped.

13. The driving method according to claim 12, wherein one of the first start signal and the second start signal is phase-shifted forward, and one of the first stop signal and the second stop signal is phase-shifted forward.

14. The driving method according to claim 12, wherein one of the first start signal and the second start signal is phase-shifted backward, and one of the first stop signal and the second stop signal is phase-shifted backward.

15. The driving method according to claim 12, wherein the pixel array further comprises a plurality of pixel electrodes respectively corresponding to one of the odd gate lines or one of the even gate lines.

16. The driving method according to claim 15, wherein the driving method further comprises:

when the corresponding odd gate line or the even gate line is located on the second side of the pixel electrode, one of the first start signal and the first stop signal and the second start signal and the second stop signal are phase-shifted by at least one clock cycle from the preset phase in the second scan period.

17. The driving method according to claim 16, wherein a phase relationship between the first start signal and the second start signal in the second scan period is vst_R=Vst_L+(m−0.5)*C_CLK, wherein vst_R is a start time point of the second start signal, Vst_L is a start time point of the first start signal, C_CLK is a clock cycle, and m is a random integer not equal to 0.

18. The driving method according to claim 15, wherein the driving method further comprises:

when the corresponding odd gate line or the even gate line is located on the first side of the pixel electrode, one of the first start signal and the first stop signal and the second start signal and the second stop signal are phase-shifted by at least one clock cycle from the preset phase in the first scan period.

19. The driving method according to claim 18, wherein a phase relationship between the first start signal and the second start signal in the first scan period is vst_R=Vst_L+(m+0.5)*C_CLK, wherein vst_R is a start time point of the second start signal, Vst_L is a start time point of the first start signal, C_CLK is a clock cycle, and m is a random integer not equal to 0.

20. The driving method according to claim 12, wherein a phase difference between the phase of the first start signal and the phase of the second start signal is equal to a horizontal scan period.

* * * * *